US009744679B2

(12) United States Patent
Wang

(10) Patent No.: US 9,744,679 B2
(45) Date of Patent: Aug. 29, 2017

(54) MULTIFUNCTIONAL TOOL

(71) Applicants: HANGZHOU GREAT STAR TOOLS CO., LTD, Hangzhou (CN); HANGZHOU GREAT STAR INDUSTRIAL CO., LTD, Hangzhou (CN)

(72) Inventor: Weiyi Wang, Hangzhou (CN)

(73) Assignees: HANGZHOU GREAT STAR TOOLS CO., LTD., Hangzhou, Zhejiang Province (CN); HANGZHOU GREAT STAR INDUSTRIAL CO., LTD, Hangzhou, Zhejiang Province (CN)

( * ) Notice: Subject to any disclaimer, the term of this patent is extended or adjusted under 35 U.S.C. 154(b) by 223 days.

(21) Appl. No.: 14/369,871

(22) PCT Filed: May 26, 2014

(86) PCT No.: PCT/CN2014/078400
§ 371 (c)(1),
(2) Date: Sep. 26, 2014

(87) PCT Pub. No.: WO2015/180011
PCT Pub. Date: Dec. 3, 2015

(65) Prior Publication Data

US 2015/0336282 A1 Nov. 26, 2015

(51) Int. Cl.
*B26B 17/00* (2006.01)
*B26B 11/00* (2006.01)
(Continued)

(52) U.S. Cl.
CPC ..... *B26B 11/005* (2013.01); *B25G 1/08* (2013.01); *B26B 11/00* (2013.01); *B26B 13/04* (2013.01); *B26B 13/22* (2013.01)

(58) Field of Classification Search
CPC ..... B26B 11/005; B26B 11/00; B26B 11/003; B25G 1/08
(Continued)

(56) References Cited

U.S. PATENT DOCUMENTS 674,036 A * 5/1901 Metcalf ..... B26B 13/22 30/122
6,223,372 B1 * 5/2001 Barber ..... B25F 1/00 7/118
(Continued)

FOREIGN PATENT DOCUMENTS

CN 2880416 3/2007
CN 102114639 7/2011
(Continued)

OTHER PUBLICATIONS

Translation of International Search Report issued in PCT/CN2014/078400 on Feb. 17, 2015 (2 pages).

*Primary Examiner* — Omar Flores Sanchez
(74) *Attorney, Agent, or Firm* — Buchanan Ingersoll & Rooney PC

(57) ABSTRACT

The present invention discloses a multifunctional tool, wherein one blade carrier can be folded and stored in one handle, so that the multifunctional tool can be used as scissors and can be used as a utility knife as well. The blade of a blade carrier can be removed, a blade cartridge is mounted on the multifunctional tool, and spare blades can be stored in the blade cartridge. The blade can be replaced by saw blade, so that it can be used as a saw when it is in the form of the utility knife.

32 Claims, 13 Drawing Sheets

(51) Int. Cl.
*B25G 1/08* (2006.01)
*B26B 13/04* (2006.01)
*B26B 13/22* (2006.01)

(58) Field of Classification Search
USPC ..... 30/255, 226, 156, 177, 175, 131, 132, 30/186; 7/118
See application file for complete search history.

(56) References Cited

U.S. PATENT DOCUMENTS

| | | | | |
|---|---|---|---|---|
| 7,886,446 | B2 * | 2/2011 | Yu Chen | B26B 13/26 30/175 |
| D758,817 | S * | 6/2016 | Covel | D8/57 |
| 2003/0061715 | A1 * | 4/2003 | Heck | A01G 3/02 30/186 |
| 2004/0045173 | A1 * | 3/2004 | Ebert | B26B 17/006 30/188 |
| 2014/0033542 | A1 * | 2/2014 | Covel | B26B 13/005 30/226 |

FOREIGN PATENT DOCUMENTS

| | | |
|---|---|---|
| DE | 20108530 | 11/2011 |
| JP | H09135968 | 5/1997 |
| JP | H1080582 | 3/1998 |

* cited by examiner

MULTIFUNCTIONAL TOOL

FIELD OF THE INVENTION

The present invention relates to a hand tool, and more particularly, to a multifunctional tool.

DESCRIPTION OF THE PRIOR ART

Household hand tools have been continuously improved in their convenience and multifunction, scissors are commonly used as a common tool. Some scissors are designed for home gardening, which can prune stalks or branches or leaves of plants, and such scissors can also be applied to some household decoration materials, such as density board, joinery board, plasterboard or wire, etc. Such scissors require high strength of the blade, and the handle portion is also big as generally requiring large shear. Because of the specific object for which they are used, the probability of blades damage is relatively high, once the blades cannot be used because of being damaged, the rest parts of the scissors have to be scrapped. In view of this, scissors that the blades can be replaced appear, solving the problem effectively.

In the process of actual application, such scissors may happen some sudden situation where it is needed to replace blades, for example, when pruning in the gardening, stalks or branches or leaves whose toughness are relatively strong often twine the blade, at this point, some action of pulling hard may cause the blade falling off, and it is difficult to find it; or when shearing some boards that are relatively hard, they often make blade damage, and sometimes it is also needed to replace blade. Therefore, preparing in advance and storing spare blades are problems need to be considered.

Considering the multifunction, utility knife is more suitable to use than scissors for some environment or conditions of using, for example, the available space the tool can get into around the stalks or branches or leaves of plants need to be pruned is relatively narrow, and it is unfavourable to open the scissors, utility knife is more suitable to be used to shear at this time; and for some relatively flimsy board, shearing by scissors is often not faster or more convenient than shearing directly by utility knife. Blades can also be replaced by saw blades, increasing the range of application as a form of utility knife.

Therefore, the person skilled in the art is committed to developing a multifunctional tool, in addition to be used as scissors, this tool can be used as a utility knife or a saw, and it can replace the blade or saw blade and can store spare blades or spare saw blades.

SUMMARY OF THE INVENTION

To realize the above purpose, the present invention provides a multifunctional tool, comprising:

(a) a pair of handles, namely, a first handle comprising a receiving slot, and a second handle;

(b) a pair of blade carriers, namely, a first blade carrier fixedly connected or integral with the first blade carrier, and a second blade carrier;

(c) a blade mounted in the first blade carrier or integral with the first blade carrier;

(d) a pivot lock, by which the second blade carrier, the second handle and the first handle are pivotally connected, and which can be switched between locking state and unlocking state, respectively causing the connection of the second blade carrier and the second handle to be fixed and unfixed (the second blade carrier can move around the pivot lock relative to the second handle), and about which the second blade carrier can rotate to enter and be placed into the receiving slot.

Further, the pivot lock defines a pivot axis, namely a central axis achieving pivotal rotation, and it can slide along the pivot axis; the pivot lock comprises first locking portions, and second locking portions set at pivot joints of the second handle and the second blade carrier where the second handle and the second blade carrier are connected with the pivot lock, which realizes teeth-type connection with the first locking portions; when the first locking portions realize teeth-type connection with the second locking portions, the pivot lock is in the locking state; when the pivot lock moving along the pivot axis causes the first locking portions and the second locking portions to be disconnected from the teeth-type connection, or when the teeth-type connection cannot be realized because of the change of the relative position between the first locking portions and the second locking portions resulting from the first locking portions and the second locking portions rotating about the pivot axis after disconnected from the teeth-type connection, the pivot lock is in the unlocking state. So, only when the second handle and the second blade carrier are in some predetermined relative positions, the pivot lock can move along the pivot axis, to be switched between the locking state and the unlocking state, the pivot lock can only be in the unlocking state in the rest positions.

Further, the first locking portions and the second locking portions are respectively either teeth or grooves that matches the teeth, namely, when the first locking portions are teeth, the second locking portions are grooves; when the second locking portions are teeth, the first locking portions are grooves, the aforementioned teeth-type connection means the teeth and the grooves interlock with each other.

Further, the multifunctional tool defines a first position of the second blade carrier relative to the second handle, the first position means the relative position of the second handle and the second blade carrier when the multifunctional tool used as scissors, when the second blade carrier is in the first position, the pivot lock can be switched between the locking state and the unlocking state; when the second blade carrier is maintained in the first position, the first handle and the second handle can be close to each other around the pivot lock until the second blade carrier contacts the blade of the first blade carrier.

Further, the multifunctional tool defines a second position of the second blade carrier relative to the second handle, the second position means the relative position of the second handle and the second blade carrier when the multifunctional tool used as a utility knife; when the second blade carrier is in the second position, the pivot lock can be switched between the locking state and the unlocking state, thereby it can fix/unfix the relative position of the second blade carrier and the second handle, and the second blade carrier can be stored in the receiving slot.

Further, when the second blade carrier is maintained in the second position, the first handle is immovably maintained between the second handle and the second blade carrier.

Further, the shapes and sizes of the first locking portions are all the same or not all the same.

Further, the first locking portions and the second locking portions are respectively either teeth or grooves that matches the teeth, the aforementioned teeth-type connection means the teeth and the grooves interlock with each other; the shapes and sizes of the teeth are all the same or not all the same.

Further, the second handle comprises a limit portion, when the second blade carrier is rotated relative to the second handle about the pivot lock, along the direction away from the receiving slot, to the first position, the second blade carrier contacts the limit portion, and thereby it is unable to continue rotating.

Further, the multifunctional tool also comprises a first elastic portion acting on the pivot lock, when the pivot lock can be switched between the locking state and the unlocking state, the pivot lock is maintained in the locking state under the action of the first elastic portion, similarly, it can drive the pivot lock by resistance to the applied force of the first elastic portion, to cause it to enter the unlocking state, thereby releasing the second blade carrier, so that it can rotate about the pivot lock relative to the second handle.

Further, the first elastic portion is an elastic cantilever.

Further, the elastic cantilever is mounted on the first handle.

Further, the multifunctional tool also comprises a second elastic portion acting on the first handle and the second handle and defining a relative position of the two, or keeping the two in a specific relative position, meanwhile, the multifunctional tool is in an open state.

Further, the second elastic portion is a torsion spring.

Further, the first handle comprises a locking recess, the second handle comprises a locking slot, a slidable locking button is mounted inside the locking slot, when the locking button gets into the locking recess, the locking button is maintained inside the locking recess under the action of the second elastic portion, causing the relative position of the first handle and the second handle to maintain fixed. Namely, the structure setting of the locking slot and locking recess makes the locking button be able to slide into the locking recess when the first handle and the second handle is in a predetermined relative position, meanwhile, under the action of the second elastic portion, or under the action of the force that drives the first handle and the second handle back to the open state, the locking button is stuck in the locking recess, thereby the relative position of the first handle and the second handle is maintained fixed.

Further, when the locking button gets into the locking recess, the second blade carrier can be in the first position, and when the second blade carrier is in the first position, the second blade carrier contacts the blade.

Further, the blade is detachably mounted on the first blade carrier.

Further, the first blade carrier comprises a mounting slot, the blade is detachably mounted inside the mounting slot, and the mounting slot defines a mounting position of the blade.

Further, the first blade carrier comprises retainers for pressing/releasing the mounting slot, namely, clamping the mounting slot by the retainers to fix the blade.

Further, the retainers are retaining screws.

Further, positioning notches are arranged on the back of the blade, and positioning latches matching the positioning notches are arranged in the mounting slot, thus further preventing the blade displacement in the direction along the length of the blade.

Further, the multifunctional tool also comprises a blade cartridge for storing spare blades.

Further, the first blade carrier comprises a mounting groove matching the blade cartridge; the blade cartridge can be stored and kept in the mounting groove.

Further, the blade cartridge is pivotally connected with the first blade carrier, so that the blade cartridge can be rotated into/out of the mounting groove around the pivot.

Further, the first handle comprises a sight opening, and the sight opening is connected with the mounting groove, thus the blade cartridge stored in the mounting groove can be seen through the sight opening, it can be confirmed whether there are spare blades in the blade cartridge in the condition that it is not done to take the blade cartridge from the mounting groove.

Further, the blade cartridge comprises a socket for placing spare blades.

Further, the socket comprises a socket bottom and side walls; the socket bottom comprises a leaf spring capable of elastic activities, the leaf spring matches the side walls to clamp and keep the spare blades in the socket.

Further, the second blade carrier comprises graduated rulers.

Further, the graduated rulers are metric or imperial.

Further, the multifunctional tool also comprises a measuring tape mounted inside the first handle.

Further, the blade is a saw blade, when the multifunctional tool is used as a utility knife, it can be used as a saw by mounting a saw blade on the first blade carrier.

Further, spare blades are spare saw blades.

The multifunctional tool of the present invention has the following advantages:

1. One blade carrier of the multifunctional tool can be stored in a handle, the pivot lock device can fix the relative position of the second blade carrier and the second handle, so that the multifunctional tool of the present invention can be used as scissors and can be used as a utility knife as well.
2. The blade of the multifunctional tool can be replaced; spare blades can be stored in the blade cartridge for conveniently accessing at any time.
3. The blade can be replaced by a saw blade, so that it can be used as a saw, further increasing the range of application.
4. The pivot lock can form self-locking cooperating with the first elastic portion, so that it is more convenient to use it.
5. Graduated rulers are mounted on the blade carrier; a measuring tape is mounted in the handle, expanding the versatility.

The concept, the specific structure and the technical effect of the present invention will be further described with reference to the accompanying figures.

DETAILED DESCRIPTION OF THE PREFERRED EMBODIMENTS

The present invention will be further described with reference to the accompanying figures and the embodiments.

Figure 1:
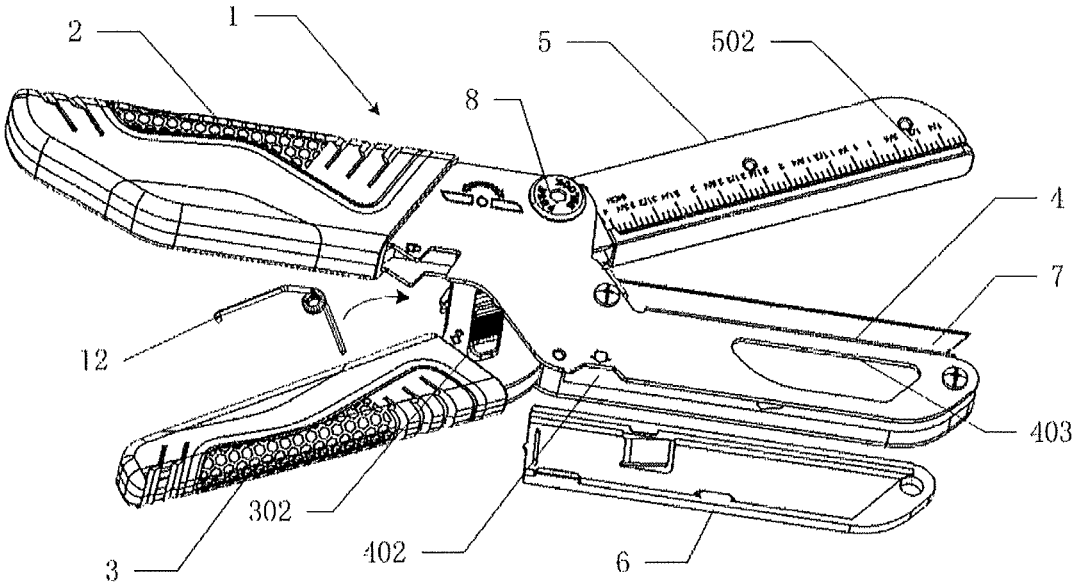
FIG. 1 illustrates a schematic view of a preferred embodiment of a multifunctional tool of the present invention.
Figure 2:
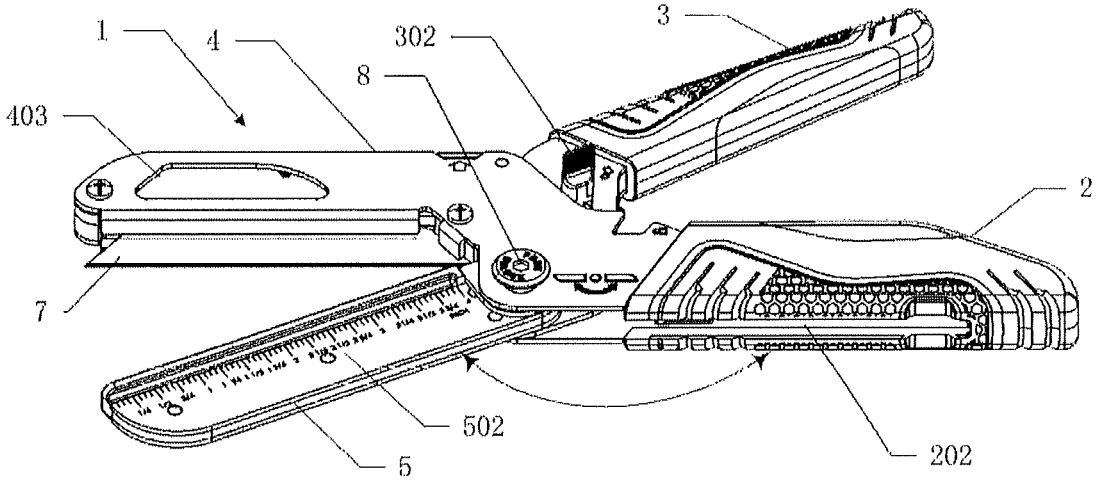
FIG. 2 illustrates another schematic view of the multifunctional tool shown in FIG. 1, showing a receiving slot on a first handle.

FIG. 1 and FIG. 2 is a preferred embodiment of the present invention, wherein the multifunctional tool 1 comprises:

(a) a pair of handles, namely, a first handle 2 comprising a receiving slot 202, and a second handle 3;

(b) a pair of blade carriers, namely, a first blade carrier 4 integral with the first handle 2 (other fixed connection methods, such as welding, riveting, can be adopted as well), and a second blade carrier 5;

(c) a blade 7 mounted in the first blade carrier 4;

(d) a pivot lock 8, by which the second blade carrier 5, the second handle 3 and the first handle 2 are pivot connected, and which can be switched between locking state and unlocking state, respectively causing the connection of the second blade carrier 5 and the second handle 3 to be fixed and unfixed (the second blade carrier 5 can move around the pivot lock 8 relative to the second handle 3), and about which the second blade carrier 5 can rotate to enter and be placed into the receiving slot 202.

Figure 3:
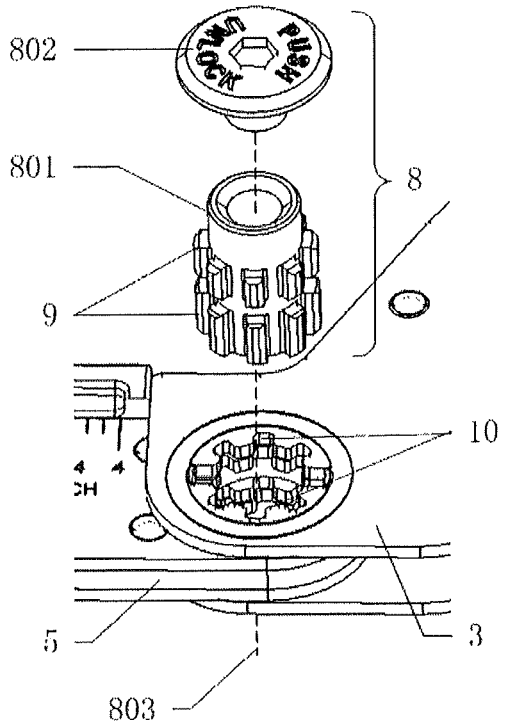
FIG. 3 illustrates a component decomposition view of the pivot lock device of the multifunctional tool shown in FIG. 1.
Figure 4:
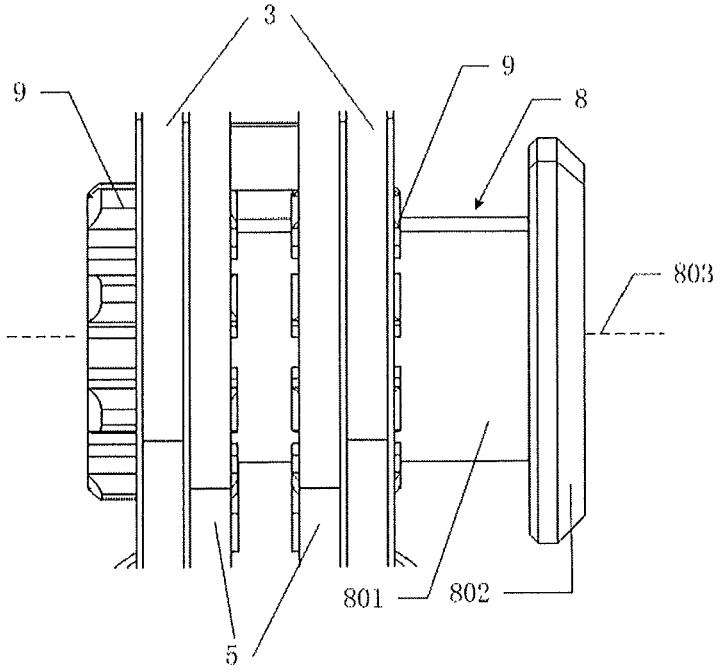
FIG. 4 illustrates a schematic view of the pivot lock shown in FIG. 3 in a locking state, the first handle portion in this position is not shown in the figure.

As shown in FIG. 3 and FIG. 4, the pivot lock 8 comprises a shaft component as a pivot, the shaft component comprises first locking portions for locking function, and second locking portions set at pivot joints of the second handle 3 and the second blade carrier 5 where the second handle 3 and the second blade carrier 5 are connected with the pivot lock 8, which realizes teeth-type connection with the first locking portions. In this embodiment, the pivot lock 8 comprises a pivot pin 801 and a cap 802, and it defines a pivot axis 803, the pivot lock 8 can move along the pivot axis, the cap 802 is installed mainly for driving the pivot lock 8 conveniently, and it is fixedly connected with the pivot pin 801, the pivot pin 801 comprises teeth 9 as the first locking portions, grooves 10 matching the teeth 9 are installed in the second handle 3 and the second blade carrier 5 as the second locking portions. When the teeth 9 and the grooves 10 interlock with each other, the pivot lock 8 is in the locking state; when the pivot lock 8 moving along the pivot axis 803 causes the teeth 9 to be disconnected from the interlock with the grooves 10, or when the teeth 9 and the grooves 10 interlock with each other because of the change of the relative position between the teeth 9 and the grooves 10 resulting from the teeth 9 and the grooves 10 rotating about the pivot axis 803 after interlocking with each other, the pivot lock 8 is in the unlocking state. The positions are sure where the pivot lock 8 can be switched between the locking state and the unlocking state by the cooperation of the teeth 9 and the grooves 10; in the position where it cannot be switched, the pivot lock 8 can only be in the unlocking state. In FIG. 4, the pivot lock 17 is in the locking state, when pressing the cap 802 causes the pivot lock 17 to move left along the pivot axis 803, it can be switched to the unlocking state. It should be pointed out that installing grooves on the pivot lock 8 and teeth on the second handle 3 and the second blade carrier 5 also can realize the above locking function.

Figure 5:
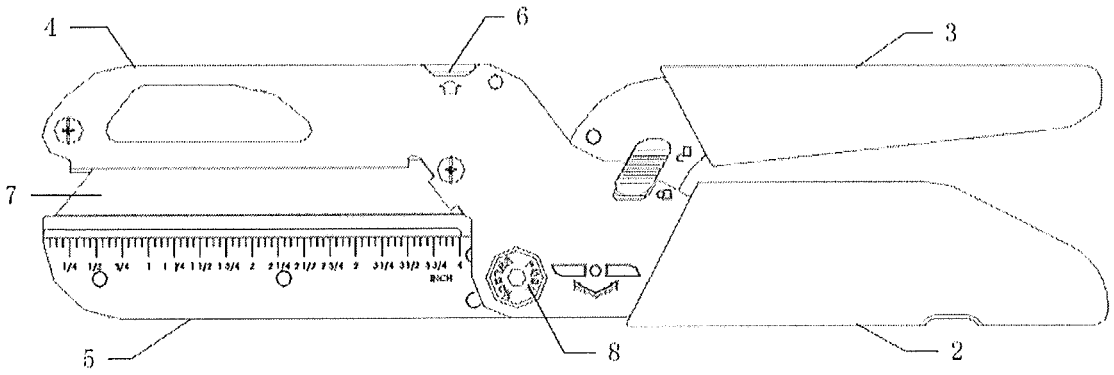
FIG. 5 illustrates a right view of the multifunctional tool shown in FIG. 1, a second handle is in a first position.
Figure 6:
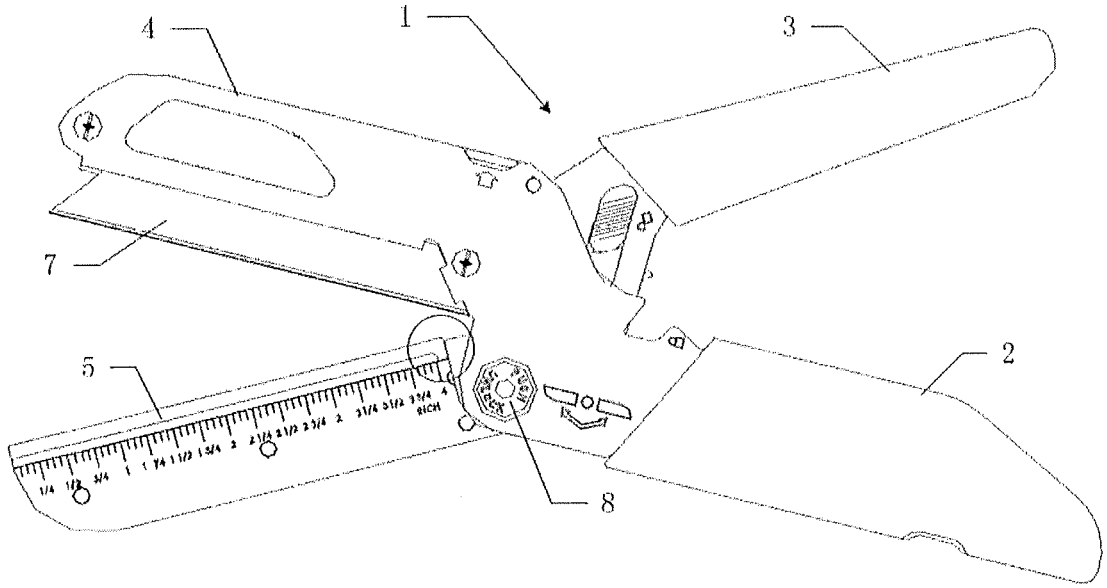
FIG. 6 illustrates a right view of the multifunctional tool shown in FIG. 1 in an open state; the second handle is in the first position.

As shown in FIG. 5 and FIG. 6, the multifunctional tool 1 defines a first position of the second blade carrier 5 relative to the second handle 3, the first position means the relative position of the second handle 3 and the second blade carrier 5 when the multifunctional tool 1 used as scissors, when the second blade carrier 5 is in the first position, the pivot lock 8 can be switched between the locking state and the unlocking state; when the second blade carrier 5 is maintained in the first position, the first handle 2 and the second handle 3 can be close to each other around the pivot lock 8 until the second blade carrier 5 contacts the blade 7 of the first blade carrier 4, thus it realizes a basic structure as scissors, the second blade carrier 5 in FIG. 5 and FIG. 6 is in the first position, in FIG. 5, the second blade carrier 5 contacts the blade 7 of the first blade carrier 4.

Figure 7:
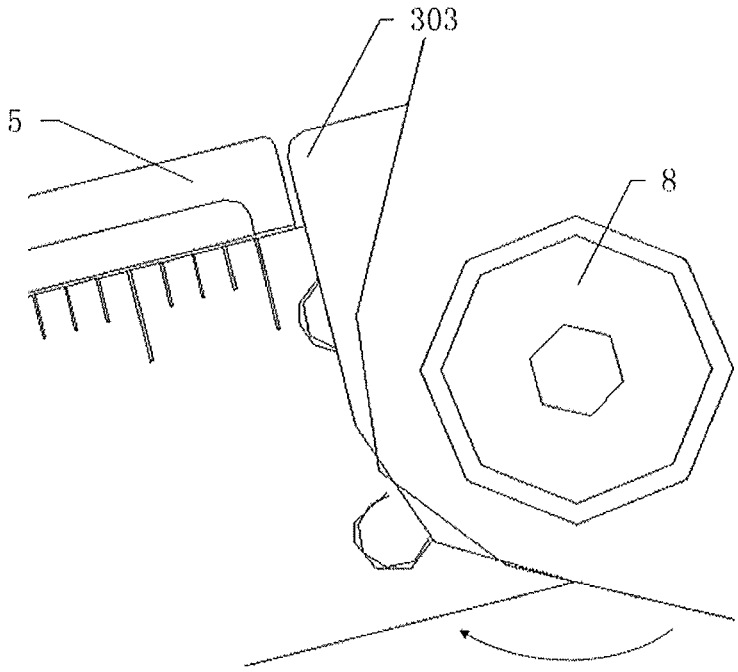
FIG. 7 illustrates a view of partial enlargement of a pivot joint of the second handle and the second blade carrier shown in FIG. 6.

As shown in FIG. 7, the second handle 3 comprises a limit portion 303, when the second blade carrier 5 is rotated relative to the second handle 3 about the pivot lock 8, along the direction away from the receiving slot 202, to the first position, the second blade carrier 5 contacts the limit portion 303, thereby it is unable to continue rotating.

Figure 8:
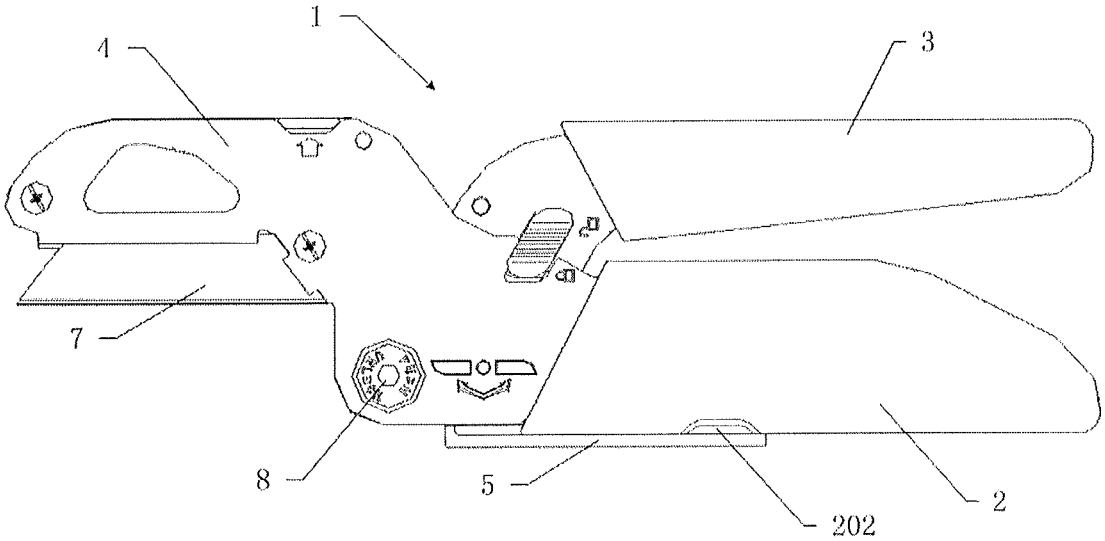
FIG. 8 illustrates a right view of the multifunctional tool shown in FIG. 1, the second handle is in a second position.

As shown in FIG. 8, the multifunctional tool 1 defines s a second position of the second blade carrier 5 relative to the second handle 3, the second position means the relative position of the second handle 3 and the second blade carrier 5 when the multifunctional tool 1 used as a utility knife; when the second blade carrier 5 is in the second position, the pivot lock 8 can be switched between the locking state and the unlocking state, thereby it can fix/unfix the relative position of the second blade carrier 5 and the second handle 3, and the second blade carrier 5 can be stored in the receiving slot 202. When the multifunctional tool 1 is used as a utility knife, storing the second blade carrier 5 in the receiving slot 202, according to the specific setting of the second position, a user holds the first handle 2 to use (the second position makes the second handle 3 and the second blade carrier 5 keep sufficient opening angle), or the user holds the first handle 2 and the second handle 3 at the same time to use (the second position makes the second handle 3 relatively close to the second blade carrier 5, limiting the movable scope of the first handle 2). In this embodiment, when the second blade carrier 5 is maintained in the second position, the first handle 2 is immovably kept between the second handle 3 and the second blade carrier 5, it is more suitable to use by holding the first handle 2 and the second handle 3 at the same time.

Figure 9:
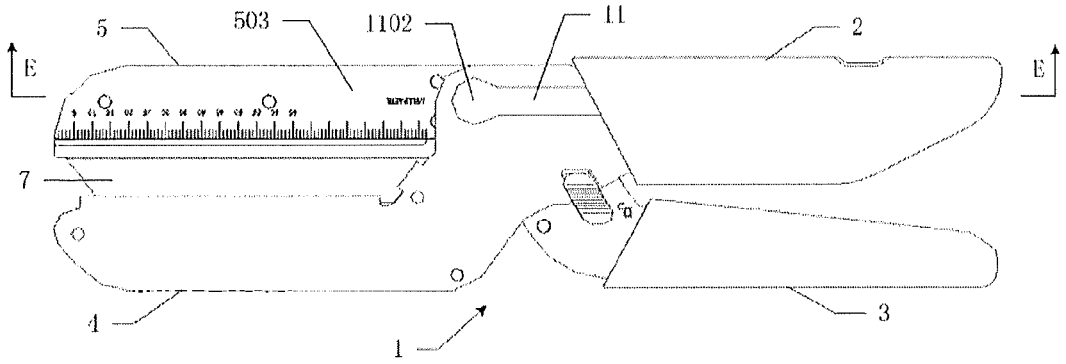
FIG. 9 illustrates a left view of the multifunctional tool shown in FIG. 1, the second handle is in the first position.
Figure 10:
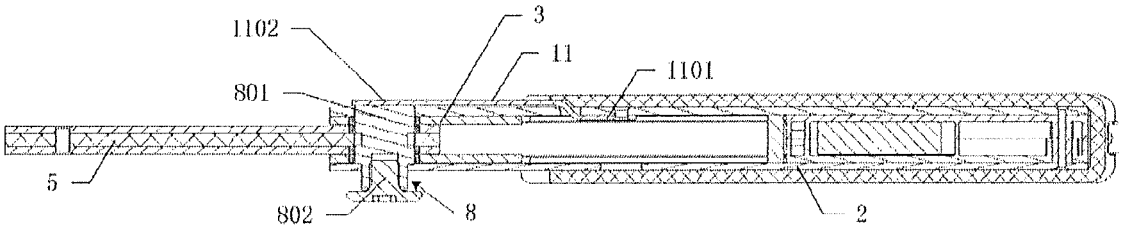
FIG. 10 illustrates a section view along line E-E in FIG. 9, the pivot lock is in the locking state.
Figure 11:
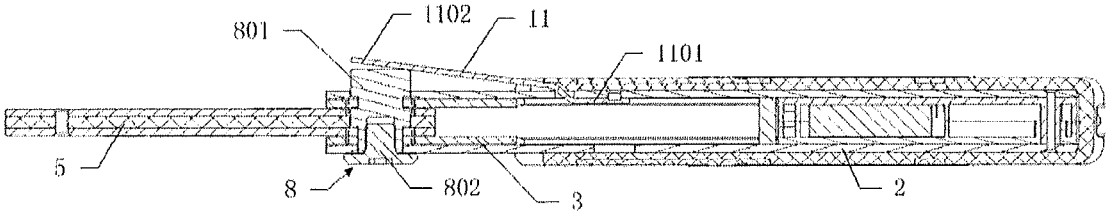
FIG. 11 illustrates a section view of the same position as in FIG. 10, the pivot lock is in the unlocking state.

As shown in FIGS. 9-11, the multifunctional tool 1 also comprises a first elastic portion acting on the pivot lock 8, in this embodiment, an elastic cantilever 11 as the first elastic portion is mounted on the first handle 2, and its lower end 1101 can be fixedly connected (welding method, riveting method, etc) to the first handle 2, and its upper end 1102 acts on the pivot pin 801 of the pivot lock 8, thus, when the pivot lock 8 can be switched between the locking state and the unlocking state, the pivot lock 8 is maintained in the locking state under the action of the 11, namely, the elastic cantilever 11 drives the pivot lock 8 to the position where the teeth 9 and the grooves 10 can interlock with each other, thus achieving self-locking function. When the pivot lock 8 is in the locking state, it can resist spring force by pressing the cap 802 in the direction close to the second handle 3 or the second blade carrier 5, to drive the pivot lock 8 to enter the unlocking state, namely, the teeth 9 and the grooves 10 are disconnected from the interlock, thus releasing the second blade carrier 5, so that it can rotate about the pivot lock 8 relative to the second handle 3. The locking state and the unlocking state of the pivot lock 8 are shown in FIG. 10 and FIG. 11 respectively.

Figure 12:
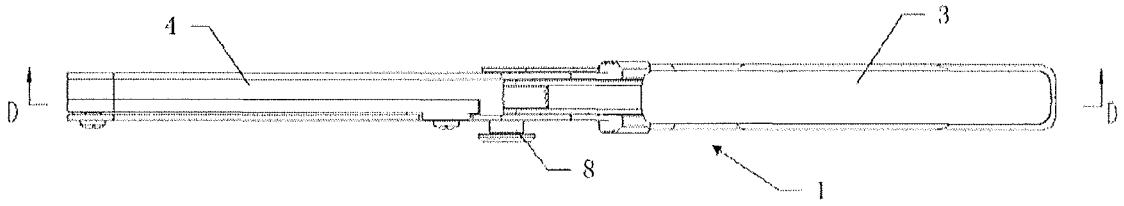
FIG. 12 illustrates a top view of the multifunctional tool shown in FIG. 1 in a close state.
Figure 13:
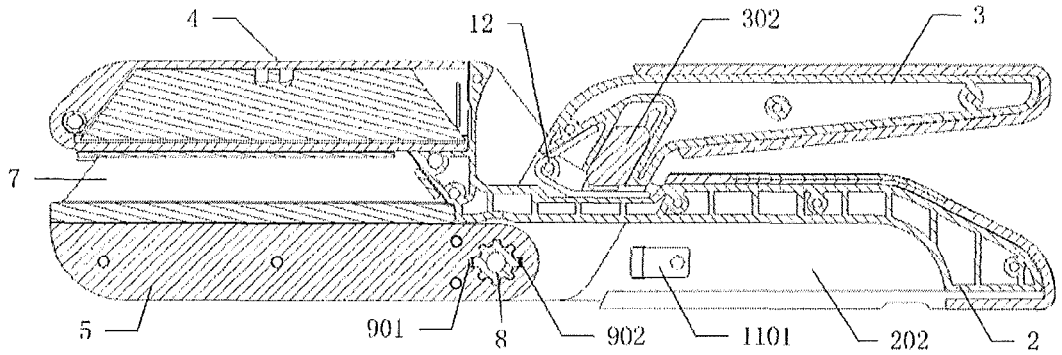
FIG. 13 illustrates a section view along line D-D in FIG. 12, the second handle is in the first position.
Figure 14:
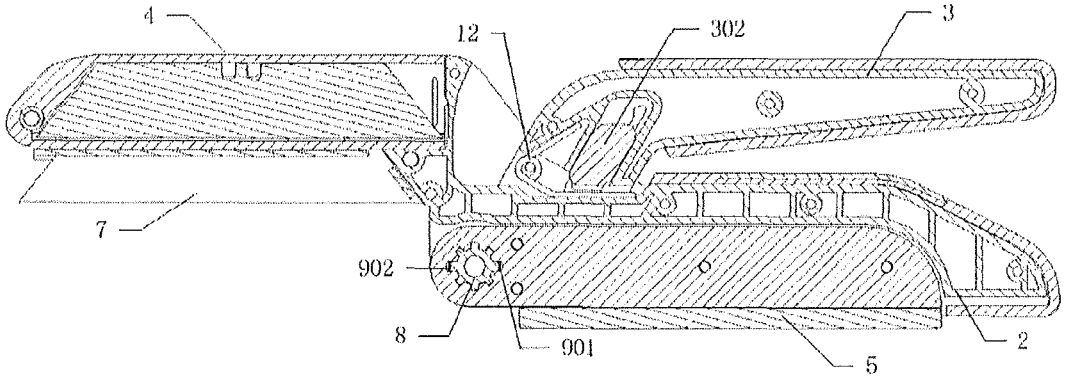
FIG. 14 illustrates a section view of the same position as in FIG. 13, the second handle is in the second position.

As shown in FIG. 12 to FIG. 14, the multifunctional tool 1 also comprises a second elastic portion, a torsion spring 12 is adopted as the second elastic portion in this embodiment, it acts on the first handle 2 and the second handle 3, and defining a relative position of the two, or maintaining the two in a specific relative position, meanwhile, the relative position of the first handle 2 and the second handle 3 defines that the multifunctional tool 1 is in an open state, namely the state shown in FIG. 1 and FIG. 4, when the multifunctional tool 1 is in the state shown in FIG. 13 and FIG. 14, it needs to resist spring force of the torsion spring 12 forcing on the first handle 2 and the second handle 3.

Figure 15:
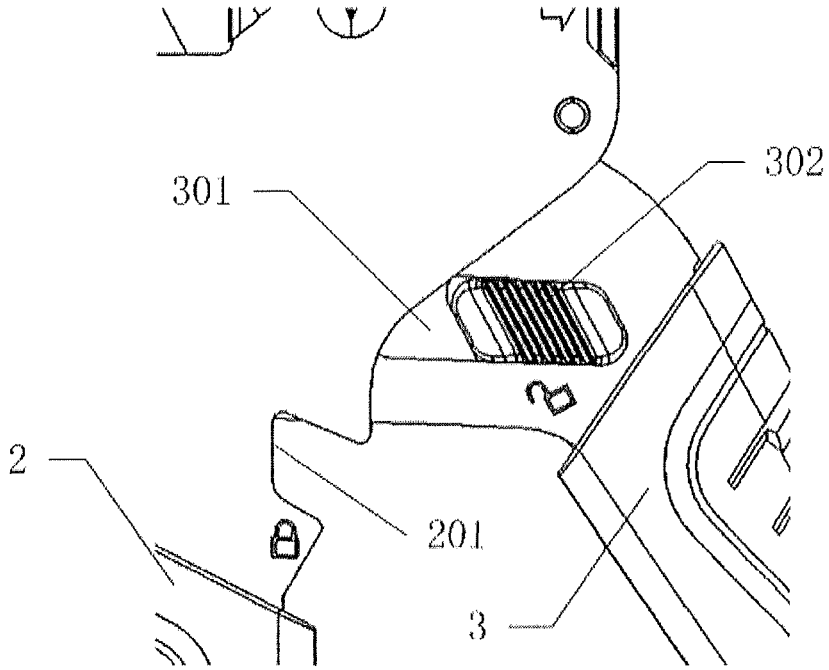
FIG. 15 illustrates a structural schematic view of the locking button, the locking slot, the locking recess of the multifunctional tool shown in FIG. 1.

As shown in FIG. 13 to FIG. 15, in order to facilitate storing the tool safely, the first handle 2 comprises a locking recess 201, the second handle 3 comprises a locking slot 301, a slidable locking button 302 is mounted inside the locking slot 301, when the locking button 302 gets into the locking recess 201, the locking button 302 is maintained inside the locking recess 201 under the action of the torsion spring 12, making the relative position of the first handle 2 and the second handle 3 keep fixed. The structure setting of the locking slot 301 and the locking recess 201 makes the locking button 302 be able to slide into the locking recess 201 only when the first handle 2 and the second handle 3 is in a specific relative position, the setting principle of the relative position is closing the scissors to prevent the edges of the blades from being exposed. In this embodiment, the relative position is also the relative position of the first handle 2 and the second handle 3 when the second blade carrier 5 is in the second position, at this time the second blade carrier 5 is rotated to the first position, then the second blade carrier 5 contacts the blade 7. Meanwhile, under the action of the torsion spring 12, the locking button 302 is stuck in the locking recess 201, thereby the first handle 2 and the second handle 3 is maintained in the relative position, as shown in FIG. 13 and FIG. 14.

The shapes and sizes of the first locking portions can be all the same or not all the same, namely, the shapes and sizes of the teeth 9 can be all the same or not all the same in this embodiment.

As shown in FIG. 13 and FIG. 14, in the process of the second blade carrier 5 rotating about the pivot lock 8 between the first position and the second position, the number and distribution of the teeth on the pivot lock 8 determine the gears, if there is a tooth wider and longer than the rest teeth and the shapes and sizes of the rest teeth are same, in this way, only the tooth is rotated to the position of the groove matching it, the pivot lock 8 can be switched between the locking state and the unlocking state, so it can be selective that the pivot lock 8 gets into the locking state automatically when it reaches a certain gear, and in other gears, the second blade carrier 5 can still move under the action of relatively small external force. In this embodiment, the pivot lock 8 is set so that it can be switched between locking state and unlocking state only when the second blade carrier 5 is in the first position and the second position, respectively corresponding to the states as shown in FIG. 13 and FIG. 14. In FIG. 13 and FIG. 14, the pivot lock 8 is in the locking state, which results from the action of a tooth 901 and a tooth 902. Wherein, the shapes and sizes of the tooth 901 and the tooth 902 are the same, and wider and longer than the rest teeth, the shapes and sizes of the rest teeth are the same. When the pivot lock 8 is in the unlocking state, rotating the second blade carrier 5, the pivot lock 8 can be switched between the locking state and the unlocking state only when the tooth 901 and the tooth 902 reach the positions of grooves matching the shapes and sizes of theirs.

The state of the multifunctional tool 1 used as a utility knife in the embodiment will be further described as follows, when the second blade carrier 5 is stored in the receiving slot 202 and the multifunctional tool 1 is in the open state, the tooth 901 and the tooth 902 do not reach the position of grooves matching them. Keeping the second blade carrier 5 in the receiving slot 202, and driving the first handle 2 and the second handle 3 close to each other at the same time, in this process, the first handle 2 and the second blade carrier 5 together approach the second handle 3 around the pivot lock 8; when the second blade carrier 5 reaches the second position, the tooth 901 and the tooth 902 reach the positions of grooves matching them, thus the pivot lock 8 enters the locking state by self-locking. When the pivot lock 8 is in the locking state, the second handle 3 and the second blade carrier 5 are kept relatively fixed, meanwhile, the first handle 2 is fixed therebetween. By such arrangement there is no movable component, and it is more benefit to use safely when the multifunctional tool 1 used as a utility knife.

Figure 16:
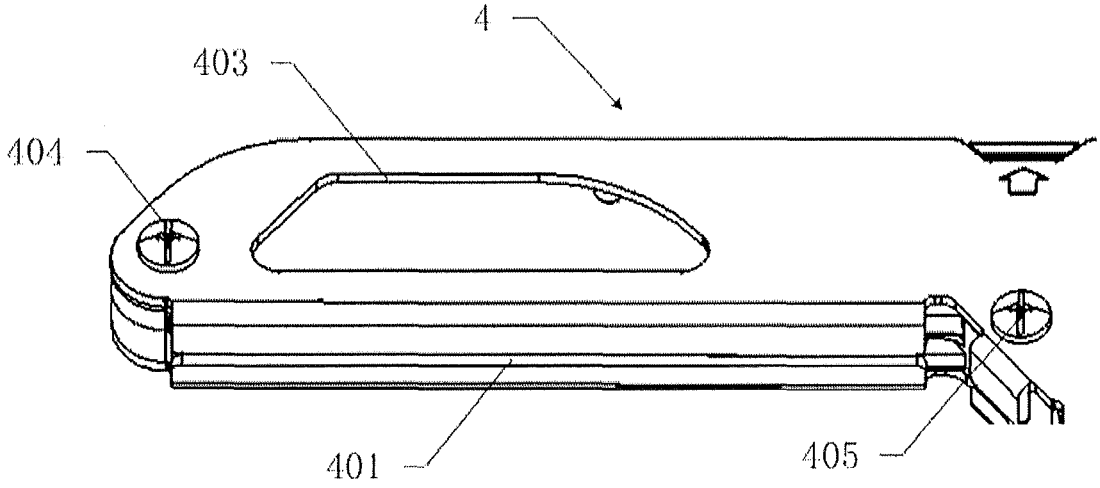
FIG. 16 illustrates a schematic view of the first blade carrier of the multifunctional tool shown in FIG. 1.
Figure 17:
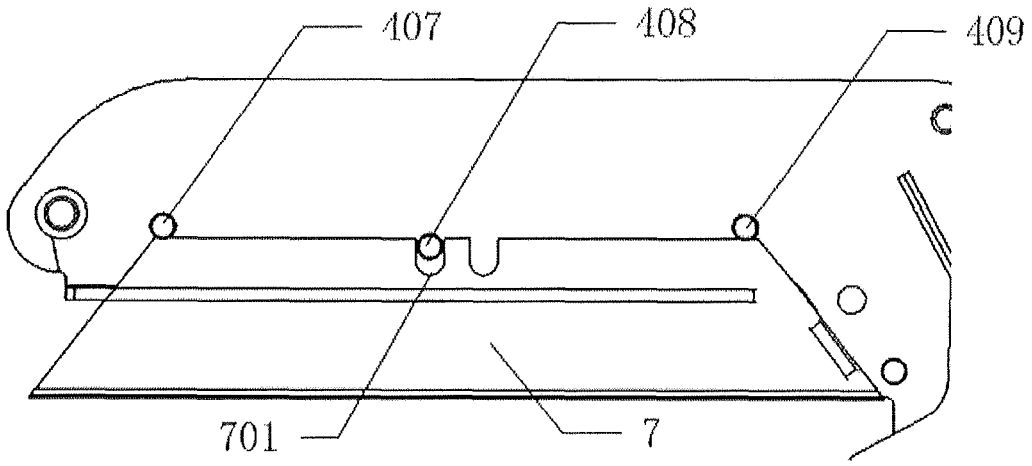
FIG. 17 illustrates a schematic view of the blade of the multifunctional tool shown in FIG. 1 mounted in the mounting slot.

As shown in FIG. 16 and FIG. 17, the first blade carrier 4 comprises a mounting slot 401; the blade 7 is mounted in the mounting slot 401. There are three positioning latches 407,408,409 within the mounting slot 401, when the blade 7 is inserted into the mounting slot 401, the positioning latches 407,409 are against the back of the blade 7, the positioning latch 408 is inserted into a positioning notch 701 in the back of the blade 7, which defines a mounting position of the blade 7. The first blade carrier also comprises retainers for pressing/releasing the mounting slot, retaining screws 404,405 are adopted in this embodiment, to compress the slot size of the mounting slot 401 and clamp the blade 7 by adjusting the retaining screws 404,405 so as to prevent it from being removed from the mounting slot 401.

Figure 18:
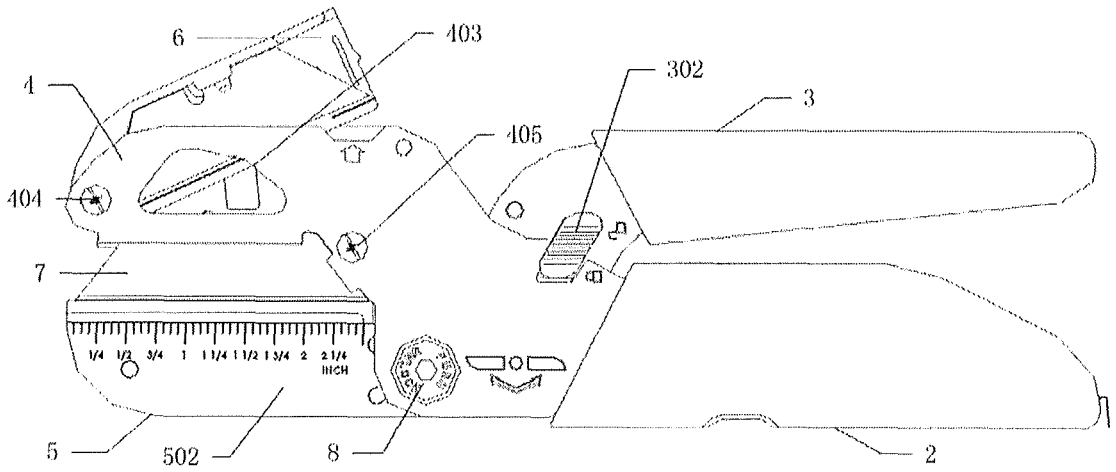
FIG. 18 illustrates a right view of the multifunctional tool shown in FIG. 1, the blade cartridge has been moved around the pivot out of the mounting groove.
Figure 19:
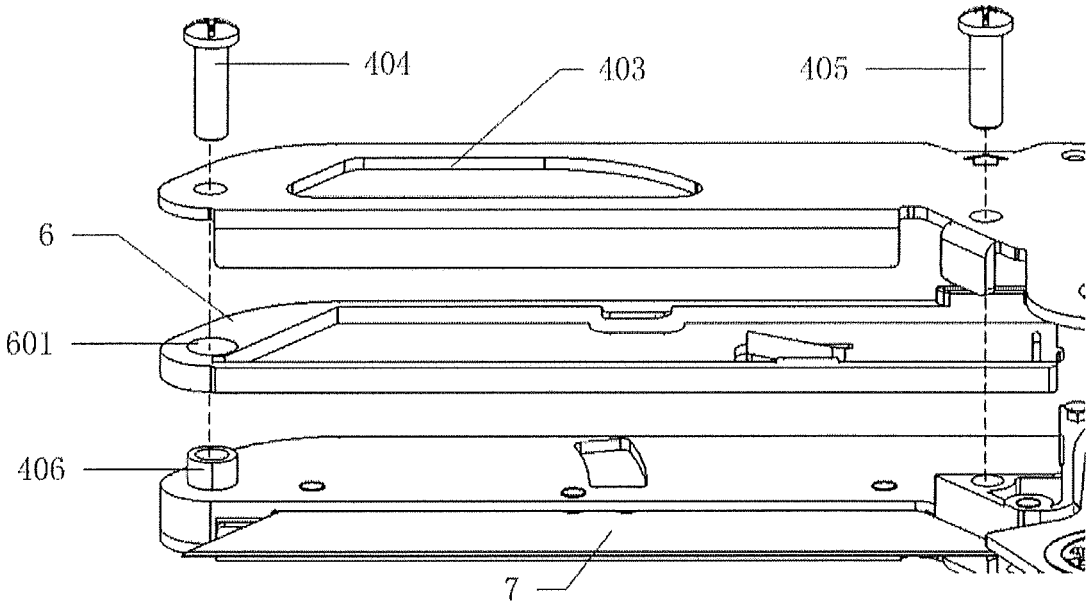
FIG. 19 illustrates a component decomposition view of the first blade carrier of the multifunctional tool shown in FIG. 16.

As shown in FIG. 1, the multifunctional tool 1 also comprises a blade cartridge for storing spare blades, the first blade carrier 4 comprises a mounting groove 402 matching the blade cartridge 6, the blade cartridge 6 can be stored and kept in the mounting groove 402. There is a hole 601 in one end of the blade cartridge 6, where the blade cartridge 6 is pivotally connected with the first blade carrier 4, so that the blade cartridge 6 can be rotated into/out of the mounting groove 402 around the pivot, as shown in FIG. 18. In this embodiment, a bulge 406 corresponding to the retaining screw 404 is the pivot of connecting the first blade carrier 4 and the blade cartridge 6, as shown in FIG. 19.

The first handle 2 comprises a sight opening 403, and the sight opening 403 is connected with the mounting groove 402, thus the blade cartridge 6 stored in the mounting groove 402 can be seen through the sight opening 403, it can be confirmed whether there are spare blades in the blade cartridge 6 in the condition that it is not done to take the blade cartridge 6 from the mounting groove 402.

Figure 20:
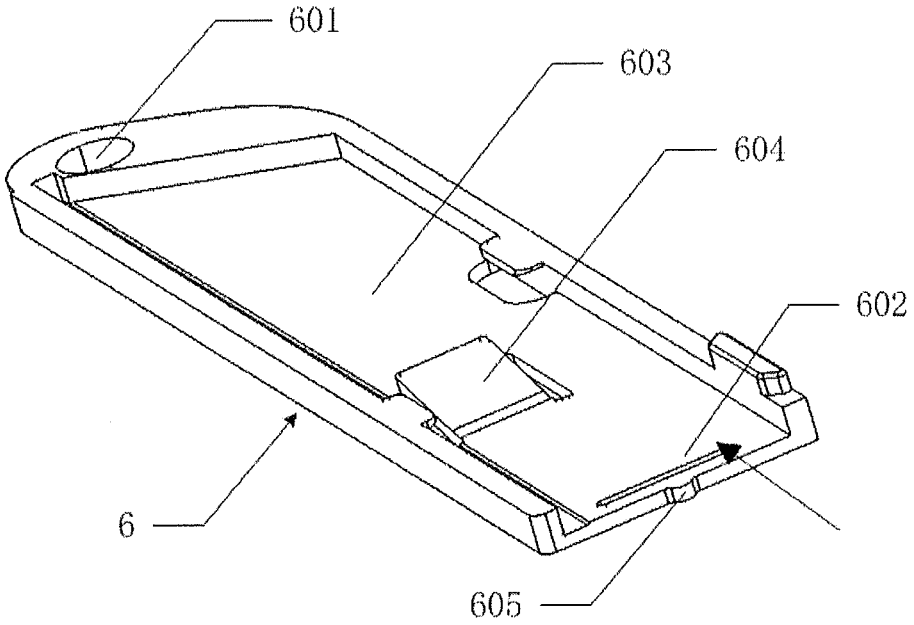
FIG. 20 illustrates a schematic view of the blade cartridge of the multifunctional tool shown in FIG. 1.
Figure 21:
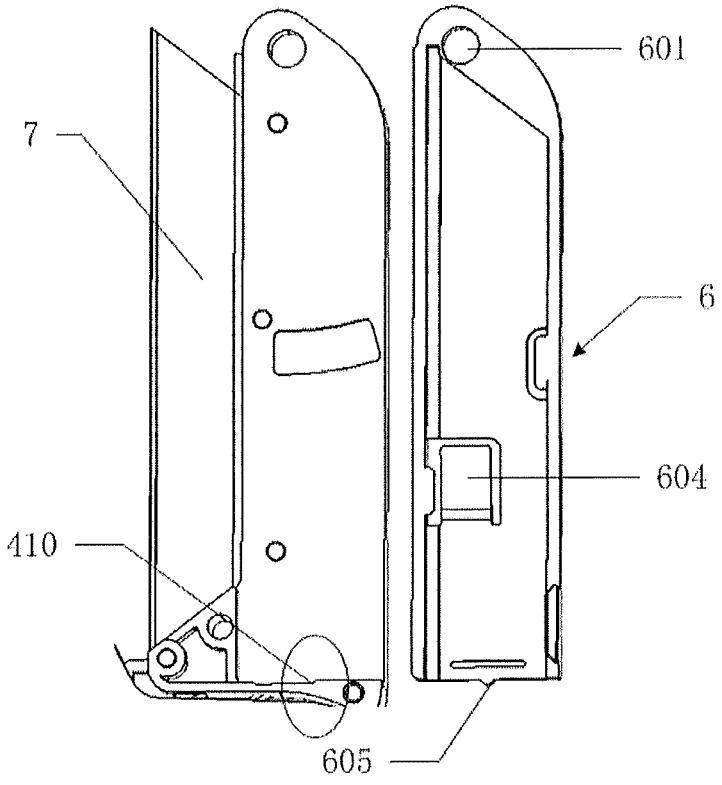
FIG. 21 illustrates a schematic view of the blade cartridge and the inside of the mounting groove of the multifunctional tool shown in FIG. 1.
Figure 22:
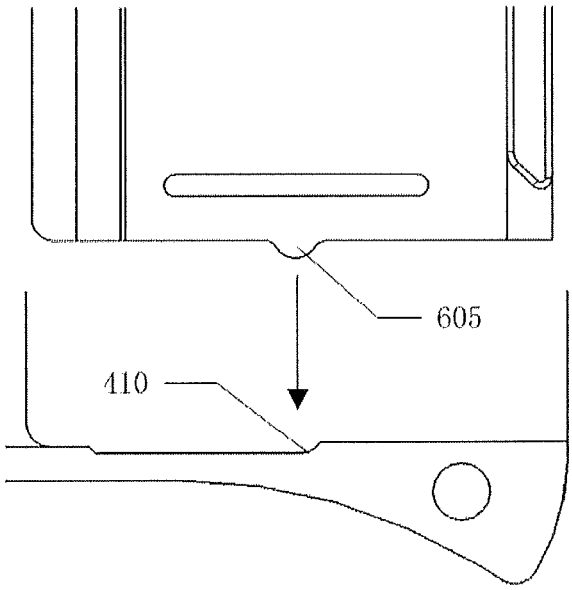
FIG. 22 illustrates a schematic view of the clasping mode for the blade cartridge inside the mounting groove shown in FIG. 21.

As shown in FIG. 20 to FIG. 22, the part of the blade cartridge 6 storing spare blades is approximately a C-shaped groove, the shape of a groove bottom 603 matches the blades that need placement, an opening 602 is arranged at one end of the groove, from which the spare blades can be inserted, and a leaf spring 604 is arranged at the groove bottom 603 against the stored blades to prevent them falling off. A protrusion 605 is arranged on the edge of the blade cartridge 6, a clamping groove 410 matching it is arranged inside the mounting groove 402, to keep the blade cartridge 6 in the mounting groove 402 by forming a clasping mode with the protrusion 605.

The multifunctional tool of this embodiment, the second blade carrier 5 comprises graduated rulers 502,503, the graduated ruler 502 is imperial, and the graduated ruler 503 is metric. The every gear of the second blade carrier 5 between the first position and the second position helps users to use the graduated rulers more conveniently.

Figure 23:
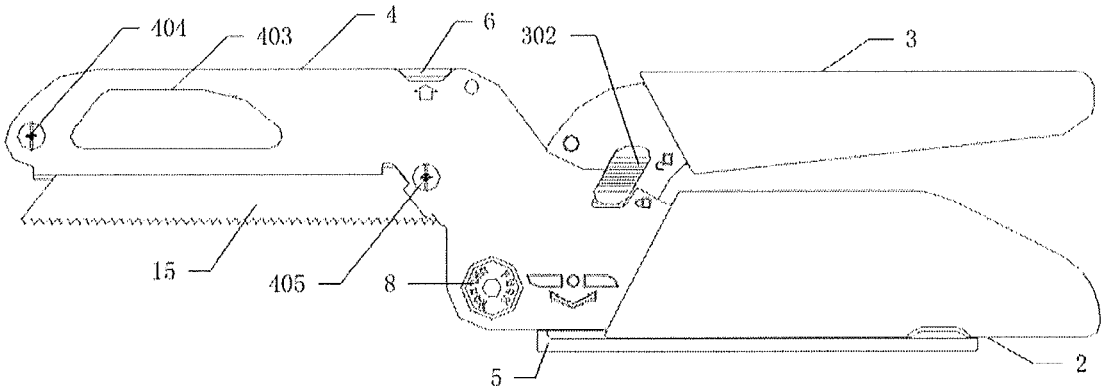
FIG. 23 illustrates a right view of the multifunctional tool shown in FIG. 1, the second blade carrier is in the second position, the blade is replaced by a saw blade.
Figure 24:
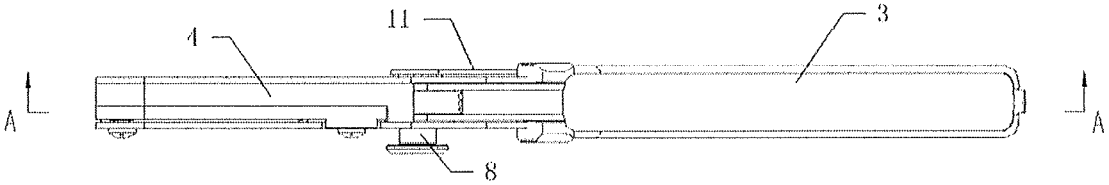
FIG. 24 illustrates a top view of another preferred embodiment of the multifunctional tool of the present invention.
Figure 25:
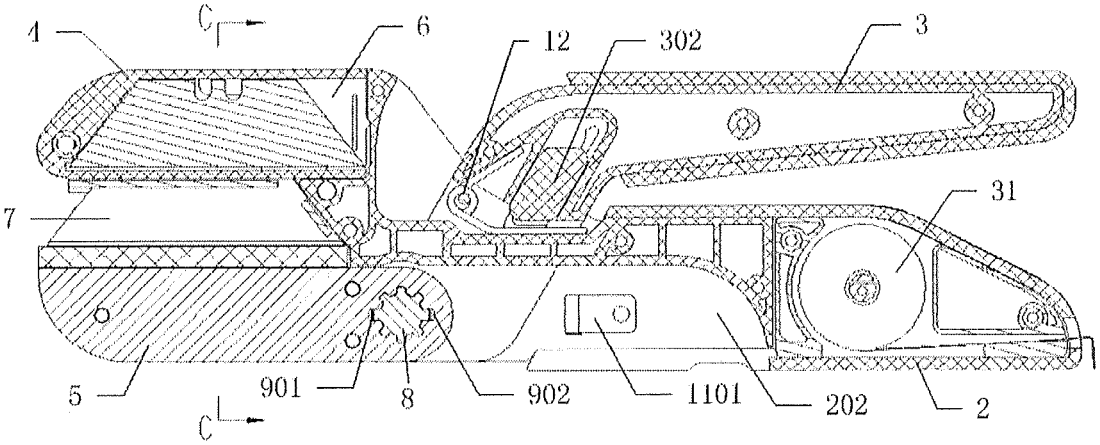
FIG. 25 illustrates a section view along line A-A in FIG. 24, the second blade carrier is in the first position.
Figure 26:
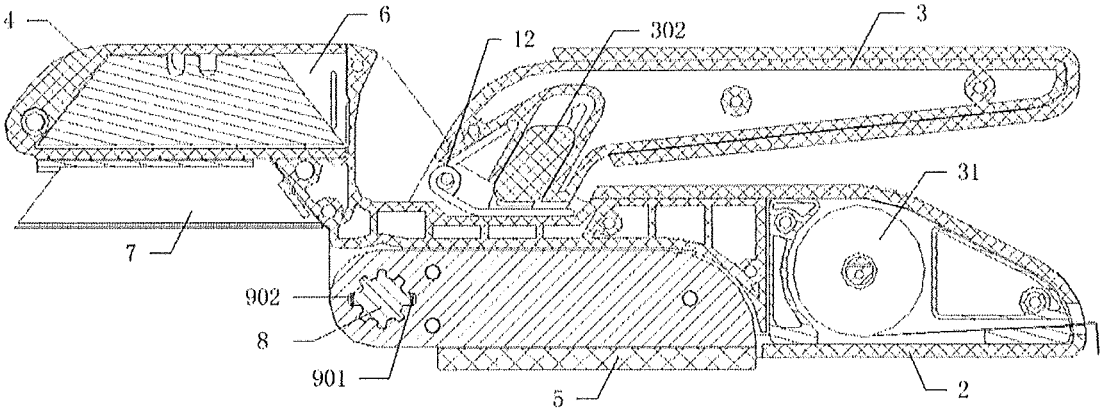
FIG. 26 illustrates a section view of the same position as in FIG. 25, the second blade carrier is in the second position.
Figure 27:
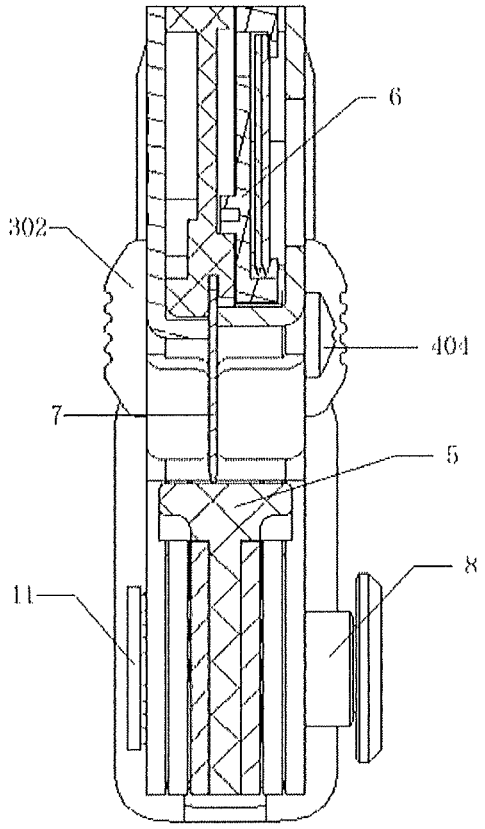
FIG. 27 illustrates a section view along line C-C in FIG. 25.

As shown in FIG. 23, the first blade carrier 4 and the blade cartridge 6 not only can carry the blades, but also can carry a saw blade 15 compliant with the specification, so that the multifunctional tool can be used as a saw as well.

FIG. 24 to FIG. 27 illustrate another preferred embodiment of the present invention; the distinction of this embodiment with the above embodiment is that a measuring tape 14 is arranged in the first handle 2, it can be drawn out from the terminal end of the first handle 2. Other structures and working methods are the same as the above embodiment.

The better embodiment of this invention is described in detail above. It shall be known that according to this invention, a common person skilled in the art does not need any creative work to conceive the modifications and variations. Therefore, any person skilled in this art can get a technical solution by logically analyzing, inferring and limited experiments, which shall be in the protecting scope defined by claims of this invention.

The invention claimed is:

1. A multifunctional tool, comprising:

a pair of handles, including a first handle and a second handle, the first handle comprising a receiving slot;

a pair of blade carriers, including a first blade carrier and a second blade carrier, the first handle being fixedly connected to or integral with the first blade carrier;

a blade mounted in the first blade carrier or integral with the first blade carrier;

a pivot lock, by which the second blade carrier, the second handle and the first handle are pivotally connected;

the pivot lock being able to be switched between a locking state and an unlocking state, respectively, leading to the fixed connection and unfixed connection between the second blade carrier and the second handle; the second blade carrier being able to rotate around the pivot lock to enter and be placed into the receiving slot.

2. The multifunctional tool of claim 1, wherein the pivot lock defines a pivot axis, and it can slide along the pivot axis; the pivot lock comprises first locking portions, and where the second handle and the second blade carrier are pivotally connected with the pivot lock is arranged with second locking portions which can form a teeth-type connection with the first locking portions; when the first locking portions form the teeth-type connection with the second locking portions, the pivot lock is in the locking state; when the pivot lock moving along the pivot axis causes the first locking portions and the second locking portions to be disconnected from the teeth-type connection, or the teeth-type connection cannot be formed because of the change of the relative position between the first locking portions and the second locking portions resulting from the first locking portions and the second locking portions rotating around the pivot axis after disconnection from the teeth-type connection, the pivot lock is in the unlocking state.

3. The multifunctional tool of claim 2, wherein the first locking portions and the second locking portions are respectively either teeth or grooves that match the teeth, the teeth-type connection means that each tooth interlocks with each groove.

4. The multifunctional tool of claim 2, wherein a first position of the second blade carrier relative to the second handle is defined, when the second blade carrier is in the first position, the pivot lock can be switched between the locking state and the unlocking state; when the second blade carrier is maintained in the first position, the first handle and the second handle can be close to each other around the pivot lock until the second blade carrier contacts the blade.

5. The multifunctional tool of claim 4, wherein a second position of the second blade carrier relative to the second handle is defined, when the second blade carrier is in the second position, the pivot lock can be switched between the locking state and the unlocking state, and the second blade carrier can be accommodated in the receiving slot.

6. The multifunctional tool of claim 5, wherein when the second blade carrier is maintained in the second position, the first handle is immovably maintained between the second handle and the second blade carrier.

7. The multifunctional tool of claim 6, wherein shapes and sizes of the first locking portions are all the same or not all the same.

8. The multifunctional tool of claim 7, wherein the first locking portions and the second locking portions are respectively either teeth or grooves that match the teeth, the teeth-type connection means that each tooth interlocks with each groove, and the shapes and sizes of the teeth are all the same or not all the same.

9. The multifunctional tool of claim 6, wherein the second handle comprises a limit portion, when the second blade carrier is rotated relative to the second handle around the pivot lock, along the direction away from the receiving slot, to the first position, the second blade carrier contacts the limit portion, thereby it is unable to continue rotating.

10. The multifunctional tool of claim 6, wherein the multifunctional tool further comprises a first elastic portion acting on the pivot lock, when the pivot lock can be switched between the locking state and the unlocking state, the pivot lock is maintained in the locking state under the action of the first elastic portion.

11. The multifunctional tool of claim 10, wherein the first elastic portion is an elastic cantilever.

12. The multifunctional tool of claim 11, wherein the elastic cantilever is mounted on the first handle.

13. The multifunctional tool of claim 6, wherein the multifunctional tool further comprises a second elastic portion acting on the first handle and the second handle and defines a relative position between the first handle and the second handle.

14. The multifunctional tool of claim 13, wherein the second elastic portion is a torsion spring.

15. The multifunctional tool of claim 13, wherein the first handle comprises a locking recess, the second handle comprises a locking slot, a slidable locking button is mounted inside the locking slot, when the locking button gets into the locking recess, the locking button is maintained inside the locking recess under the action of the second elastic portion, fixing the relative position of the first handle and the second handle.

16. The multifunctional tool of claim 15, wherein when the locking button gets into the locking recess, the second blade carrier can be in the first position, and when the second blade carrier is in the first position, the second blade carrier contacts the blade.

17. The multifunctional tool of any one of claim 1, wherein the blade is detachably mounted on the first blade carrier.

18. The multifunctional tool of claim 17, wherein the first blade carrier comprises a mounting slot, and the blade is detachably mounted in the mounting slot.

19. The multifunctional tool of claim 18, wherein the first blade carrier comprises retainers for pressing/releasing the mounting slot.

20. The multifunctional tool of claim 19, wherein the retainers are retaining screws.

21. The multifunctional tool of claim 18, wherein positioning notches are arranged on a back of the blade, and positioning latches matching the positioning notches are arranged in the mounting slot.

22. The multifunctional tool of claim 17, wherein the multifunctional tool further comprises a blade cartridge for storing spare blades.

23. The multifunctional tool of claim 22, wherein the first blade carrier comprises a mounting groove matching the blade cartridge, and the blade cartridge can be accommodated and kept in the mounting groove.

24. The multifunctional tool of claim 23, wherein the blade cartridge is pivotally connected with the first blade carrier.

25. The multifunctional tool of claim 23, wherein the first handle comprises a sight opening, and the sight opening is connected with the mounting groove.

26. The multifunctional tool of claim 22, wherein the blade cartridge comprises a socket for placing the spare blades.

27. The multifunctional tool of claim 26, wherein the socket comprises a socket bottom and side walls, the socket bottom comprises a leaf spring capable of elastic activities, and the leaf spring matches the side walls to clamp and kept the spare blades in the socket.

28. The multifunctional tool of claim 1, wherein the second blade carrier comprises graduated rulers.

29. The multifunctional tool of claim 28, wherein the graduated rulers are metric or imperial.

30. The multifunctional tool of claim 1, wherein the multifunctional tool further comprises a measuring tape mounted inside the first handle.

31. The multifunctional tool of claim 17, wherein the blade is a saw blade.

32. The multifunctional tool of claim 22, wherein the spare blades are spare saw blades.

* * * * *